US005584764A

United States Patent [19]

Inoue

[11] Patent Number: 5,584,764

[45] Date of Patent: Dec. 17, 1996

[54] SLOT MACHINE

[75] Inventor: Haruo Inoue, Tokyo, Japan

[73] Assignee: Eagle Co., Ltd., Tokyo, Japan

[21] Appl. No.: 520,504

[22] Filed: Aug. 28, 1995

Related U.S. Application Data

[63] Continuation of Ser. No. 184,033, Jan. 21, 1994, abandoned.

[51] Int. Cl.[6] ..... A63F 5/04

[52] U.S. Cl. ..... 463/20; 273/143 R

[58] Field of Search ..... 463/20, 21; 273/143 R

[56] References Cited

U.S. PATENT DOCUMENTS 4,838,552 6/1989 Hagiwara ..... 463/20

4,874,173 10/1989 Kishishita ..... 273/143 R

*Primary Examiner*—William H. Grieb

*Attorney, Agent, or Firm*—Young & Thompson

[57] ABSTRACT

A slot machine having observation windows formed in a 3×3 matrix on a front panel. Behind each observation window, a reel is mounted which is rotated by a pulse motor. When a reel stops, one symbol appears in the central area of each observation window. Eight winning lines are provided including three vertical lines, three horizontal lines and two diagonal lines. These winning lines are made valid in accordance with the number of inserted coins. The reels are stopped in a predetermined order. If a combination of symbols on a valid winning line is a winning symbol combination, coins corresponding in number to the rank of the winning symbol combination are paid out.

5 Claims, 7 Drawing Sheets

SLOT MACHINE

This application is a continuation of application Ser. No. 08/184,033, filed Jan. 21, 1994, now abandoned.

BACKGROUND OF THE INVENTION

1. Field of the Invention

The present invention relates to a slot machine, and more particularly to a slot machine in which a plurality of reels are arranged in a matrix.

2. Description of the Related Art

In a conventional slot machine, a plurality of reels, for example, three to five reels are disposed in a horizontal row. These reels are rotated at the same time, upon actuation of a start lever. The reels are thereafter stopped sequentially at random timings. In a manual stop type, a stop button is provided for each reel and upon actuation of a stop button the corresponding reel stops. Various symbols such as "7", "apple", "banana", "star" and "bell" are displayed on the outer circumference frame of each reel.

In a conventional slot machine, an observation window is provided for each reel, and three symbols are fully visible through each observation window. Three horizontal winning lines are thus formed, each winning line including three symbols in the upper, middle or lower areas of the observation windows. Two additional winning lines are also formed diagonally by three symbols in the case of three windows. A conventional slot machine has therefore a maximum of five winning lines in all. The number of valid winning lines increases up to this maximum as the number of coins (including tokens) inserted into a coin inlet prior to the start of a game increases. For example, one horizontal winning line is made valid if one coin is inserted, three horizontal winning lines are made valid if two coins are inserted, and all five winning lines are made valid if three coins are inserted.

A slot machine which is operable with a pre-paid card has recently been proposed. With a slot machine of this type, a credit button is operated prior to starting a game, and the number of coins to be bet is determined by the number of times the credit button is pushed.

When all the reels stop, and if any combination of a plurality of symbols on a valid winning line is a winning symbol combination, a predetermined number of coins corresponding to the rank of the winning symbol combination are paid out. Alternatively, instead of paying out actual coins, a credit counter is actuated in some slot machines.

In order to increase a player's enjoyment of the game, a plurality of bonus games can be awarded to the player if all the symbols on a particular winning line are "7". The nature of a bonus game can change with the type of slot machine. For example, in some slot machines, when one coin is entered, only one reel rotates. If a particular symbol appears when the reel stops, a win or hit is given. In such a bonus game, the reels are controlled to stop so as to make a particular winning symbol appear with a high probability.

Conventional slot machines such as described above have only five winning lines, thus providing relatively few chances to win. Furthermore, if the first stopped reel does not show the symbol "7", the player knows at this time that there is no longer any chance of winning a bonus game which the player has most desired; so the player loses interest in the game even though the remaining reels are still rotating.

OBJECTS OF THE INVENTION

It is an object of the present invention to provide a slot machine having an increased number of winning lines and thus providing more chances to win.

It is another object of the present invention to provide a slot machine capable of maintaining the player's interest in the game until the last reel stops.

SUMMARY OF THE INVENTION

The above and other objects of the present invention can be achieved by arranging a plurality of reels in an M×N matrix. According to a preferred embodiment of the present invention, reels are arranged in a 3×3 matrix. If one of the reels at the corners of the matrix arrangement is adapted to be stopped last, then the symbol combinations on three winning lines including a vertical line, a horizontal line, and a diagonal line are determined only at the end of the game. If the reel at the center of the matrix arrangement is adapted to be stopped last, the symbol combinations on four winning lines including a vertical line, a horizontal line, and two diagonal lines are determined at the end of the game when the center reel stops.

BRIEF DESCRIPTION OF THE DRAWINGS

The above and other objects and advantages of the present invention will become apparent from the following detailed description of the preferred embodiments when read in conjunction with the accompanying drawings, in which.

DETAILED DESCRIPTION OF THE PREFERRED EMBODIMENTS

Figure 1:
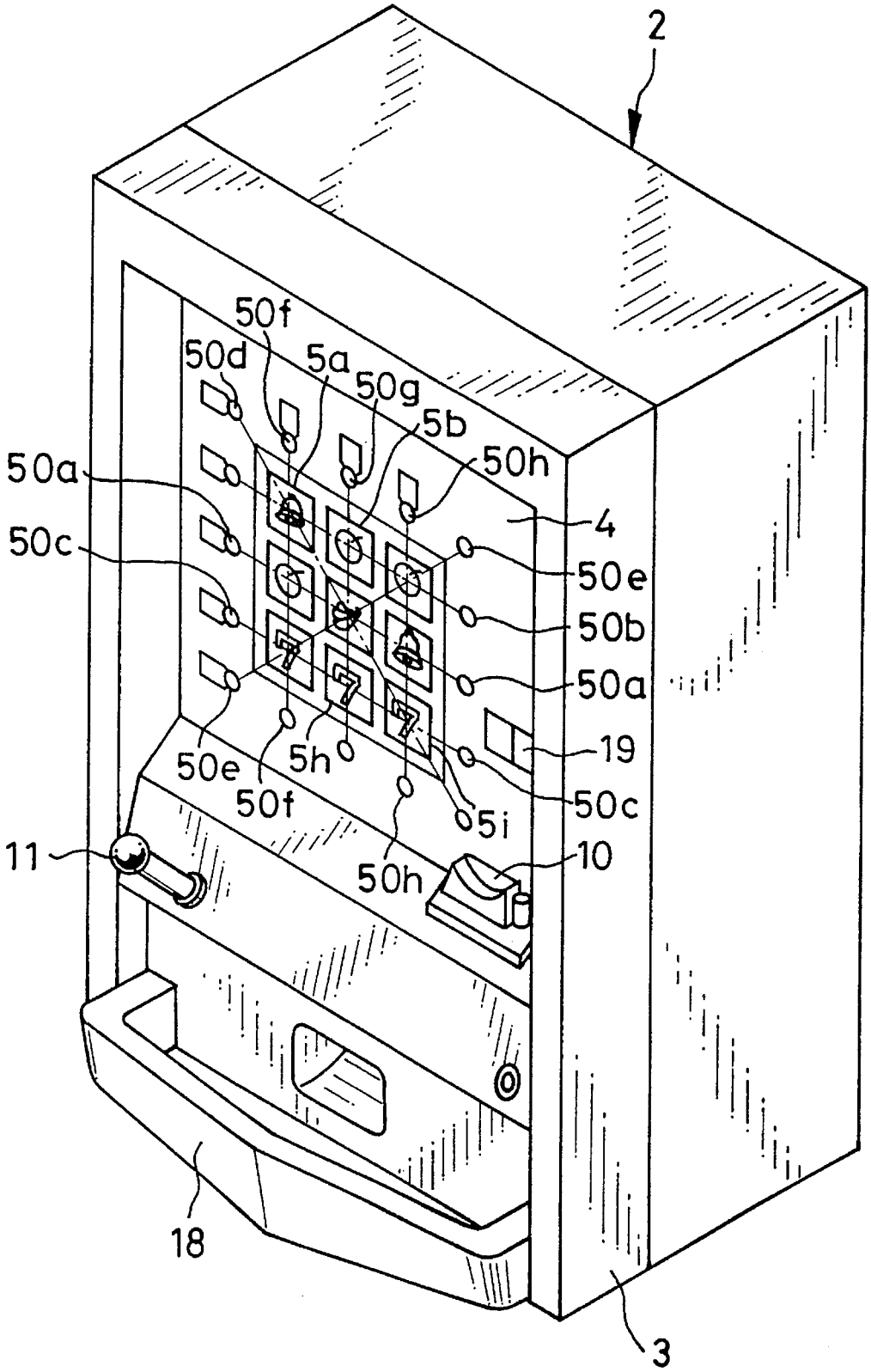
FIG. 1 is a perspective view of a slot machine according to the present invention.
Figure 2:
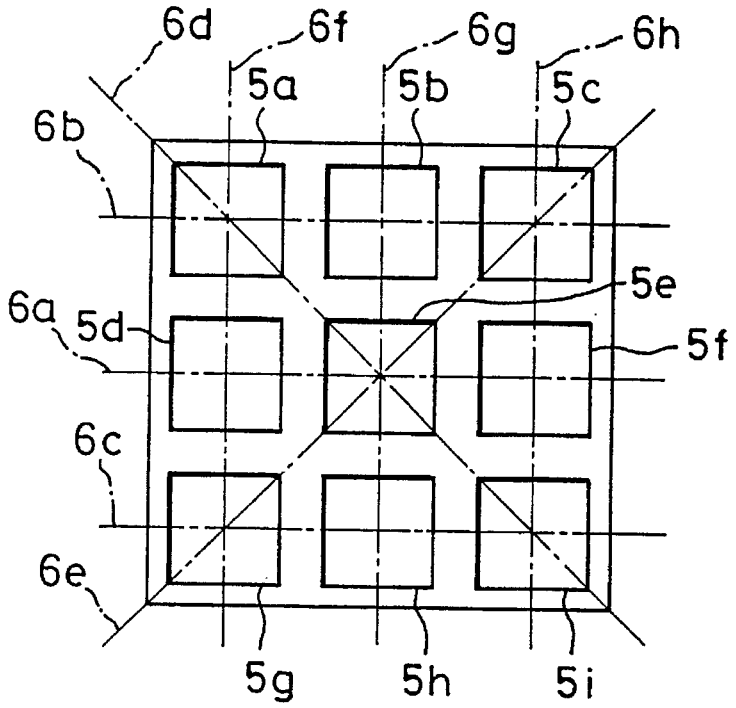
FIG. 2 is a diagram explaining the relationship between observation windows and winning lines.
Figure 3:
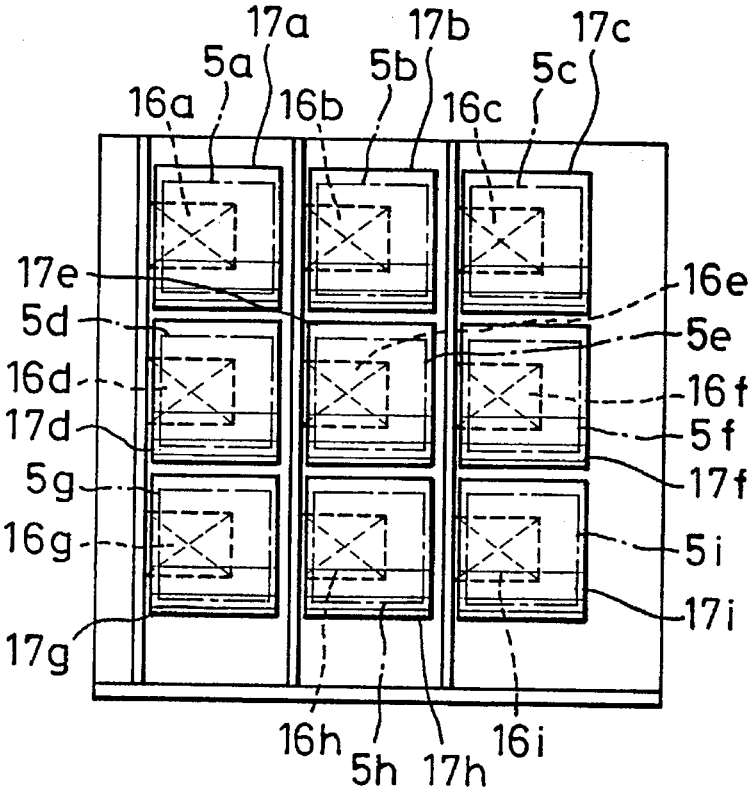
FIG. 3 is a front view of a reel unit.

Referring to FIG. 1 showing a slot machine of the invention, a front door 3 which can be opened and closed is mounted on the main frame 2 of the slot machine. A panel 4 is mounted in the central area of the front door 3. A plurality of observation windows are disposed in an M×N matrix (M and N being integers). In this embodiment, as particularly shown in FIG. 2, nine observation windows 5*a* to 5*i* are formed in a matrix. On the panel 4, eight winning lines 6*a* to 6*h* are formed, each traversing a unique combination of three observation windows. As shown in FIG. 3, first to ninth reels 17*a* to 17*i* are rotatively mounted rearwardly of the observation windows 5*a* to 5*i*.

A coin inlet 10 and a start lever 11 are mounted on the front door 3. A coin discriminator for discriminating between false and genuine coins or tokens, which will be collectively called "coins" hereinafter, and for rejecting a false coin and accepting a genuine coin, and a coin sensor for detecting a genuine coin, are mounted along a coin path extending from the coin inlet 10. Prior to starting a game, a coin is inserted into the coin inlet 10 so that start lever 11 is made active and the valid winning lines corresponding to the number of entered coins are displayed.

Figure 4:
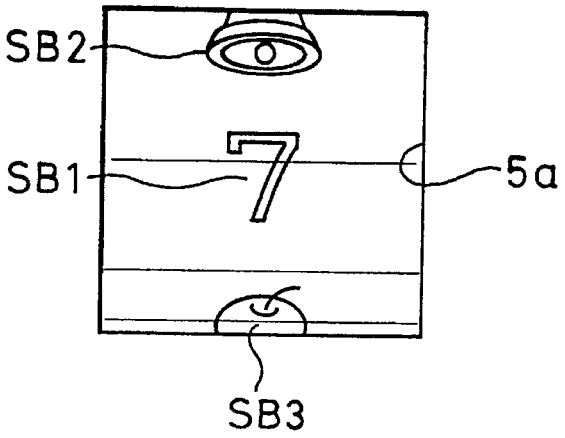
FIG. 4 is a diagram explaining how symbols are observed through an observation window.

When the start lever 11 is operated, nine pulse motors 16*a* to 16*i* shown in FIG. 3 start rotating to rotate the first to ninth reels 17*a* to 17*i* at the same time. As is well known, symbols are depicted at an equal pitch on the outer circumferences of these reels 17*a* to 17*i*, each symbol being observed via the observation windows 5*a* to 5*i* indicated by phantom lines. As is shown in FIG. 4, when a reel stops, three symbols SB1 to SB3 can be observed. Of the three symbols, only the center symbol SB1 appears fully, and the other two symbols SB2 and SB3 on the upper and lower sides of the center symbol SB1 appear only partially with half of each being shielded by the margins of the windows. The reason why the two symbols SB2 and SB3 are displayed incompletely on the upper and lower sides of the center symbol SB1 which is used for judging a win, is that the impression of a near miss can thus be given to the player, so that the player looks forward to the next game with undiminished hope.

When the first to ninth reels 17*a* to 17*i* stop, and if any combination of symbols on a valid winning line is a winning combination, the winning line, which has already been illuminated continuously because it was played, is now caused to flash. Thereafter, a predetermined number of coins corresponding to the rank of the winning symbol combination is paid out into a coin saucer 18. The number of paid-out coins is displayed on a display unit 19 mounted above the coin inlet 10.

Figure 5:
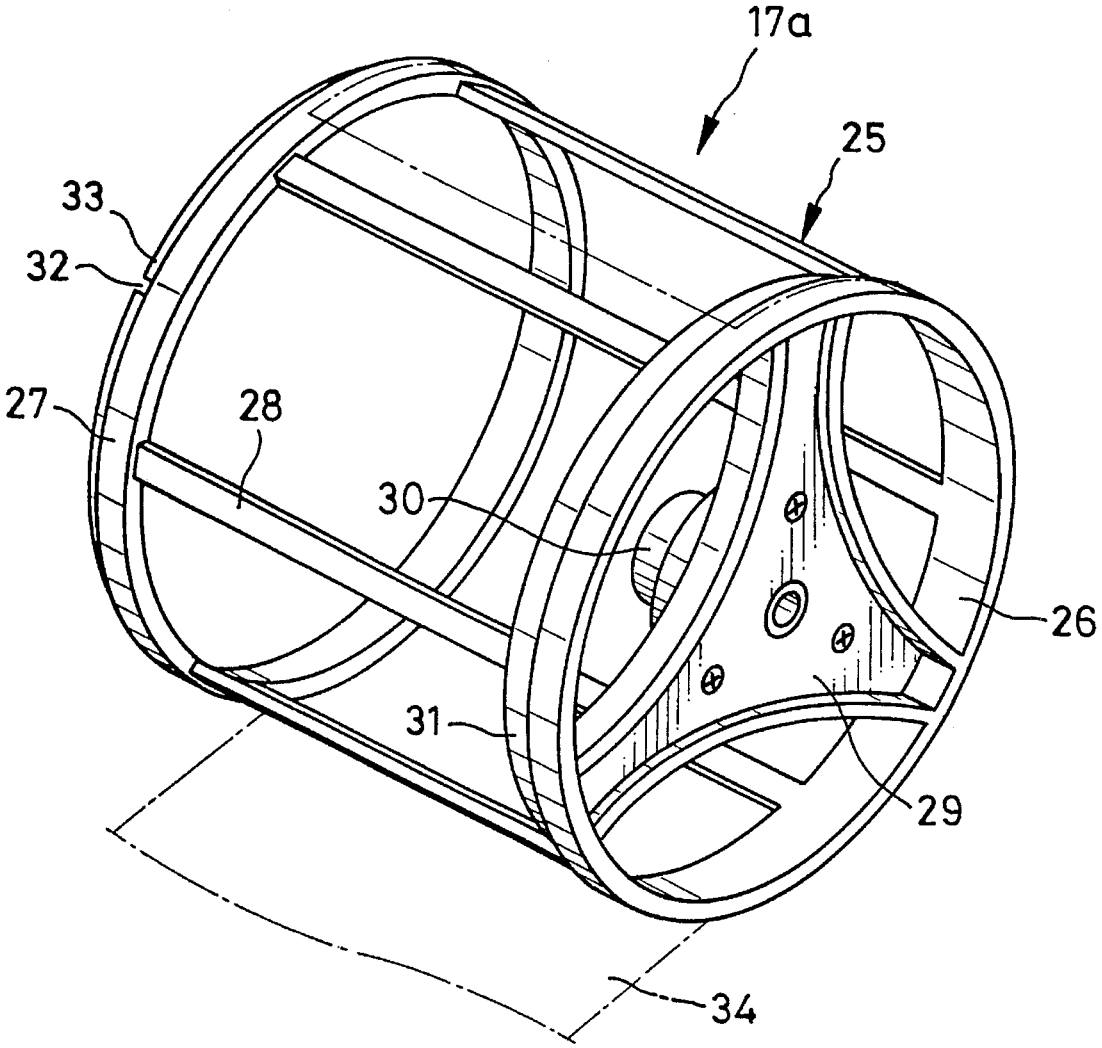
FIG. 5 is a perspective view of the body of a reel.

Referring to FIG. 5 showing the reel 17*a*, a cylindrical reel body 25 is constructed of a pair of rings 26 and 27 and six stays 28. The ring 26 is integrally formed with a side stay 29 to which a coupler 30 is fastened by three screws. The coupler 30 is fitted to the shaft of the corresponding pulse motor. The ring 26 has a tapered surface 31 on the side of the stays 28. The other ring 27 is integrally formed with a flange 33 which has a recess 32. The recess 32 is used for detecting a home position of the reel body 25. A sheet 34 indicated by a phantom line is attached to the outer circumference of the reel body 25. As is well known, symbols such as "7", "apple", "banana", "star" and "bell" are displayed with an equal pitch on this sheet 34.

Figure 6:
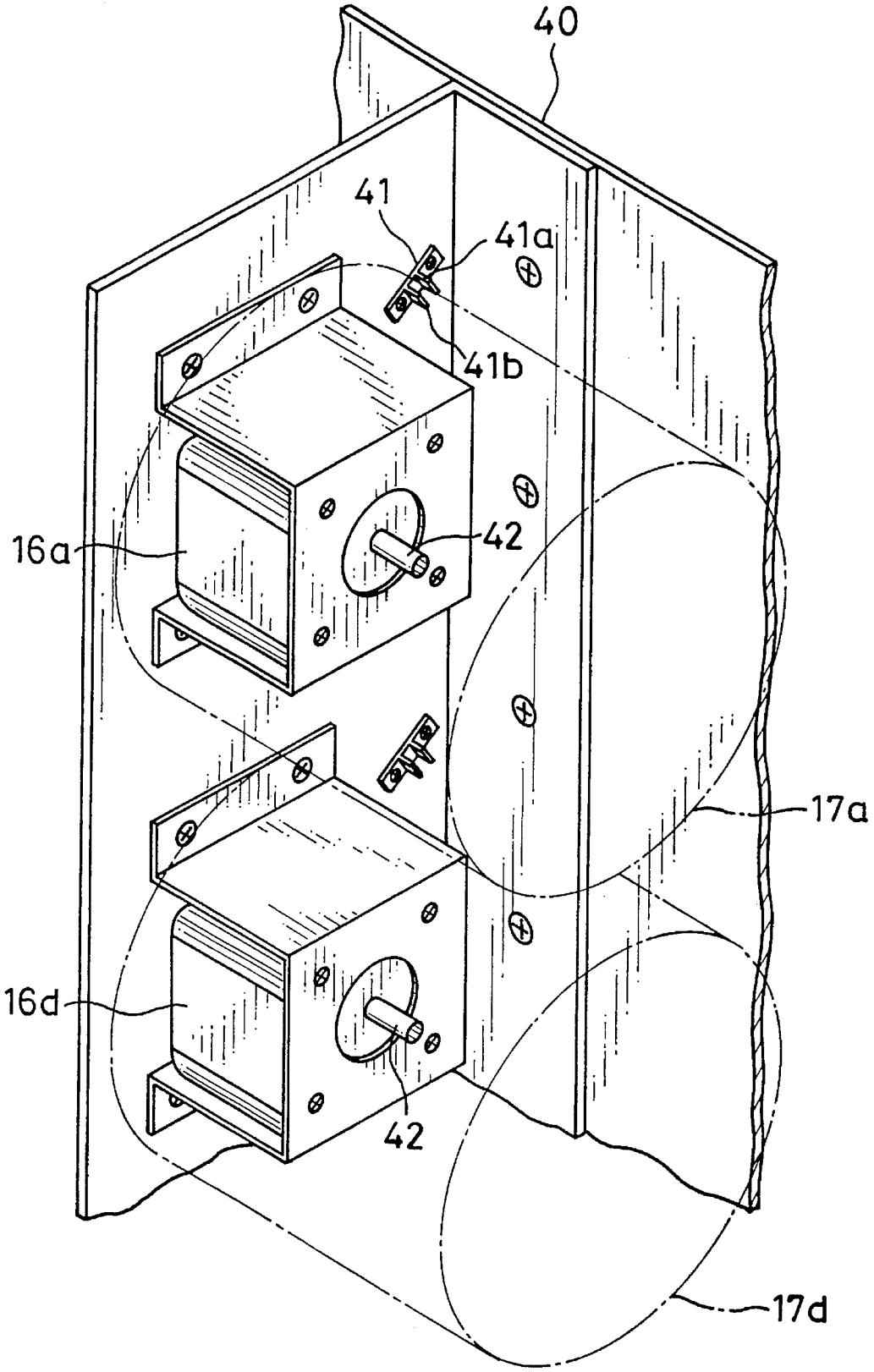
FIG. 6 is an enlarged fragmentary perspective view of the reel unit.

Referring to FIG. 6 showing a reel unit in an enlarged fragmentary perspective view, a pulse motor 16*a* and a photo sensor 41 for detecting the recess 32 of the reel body 25 are fixed to a base plate 40 by means of screws. The coupler 30 is fitted to the shaft 42 of the pulse motor 16*a*. In this condition, the flange 33 is disposed between a light projector 41*a* and a light receiver 41*b* of the photo sensor 41 to allow the recess 32 to be sensed.

Figure 7:
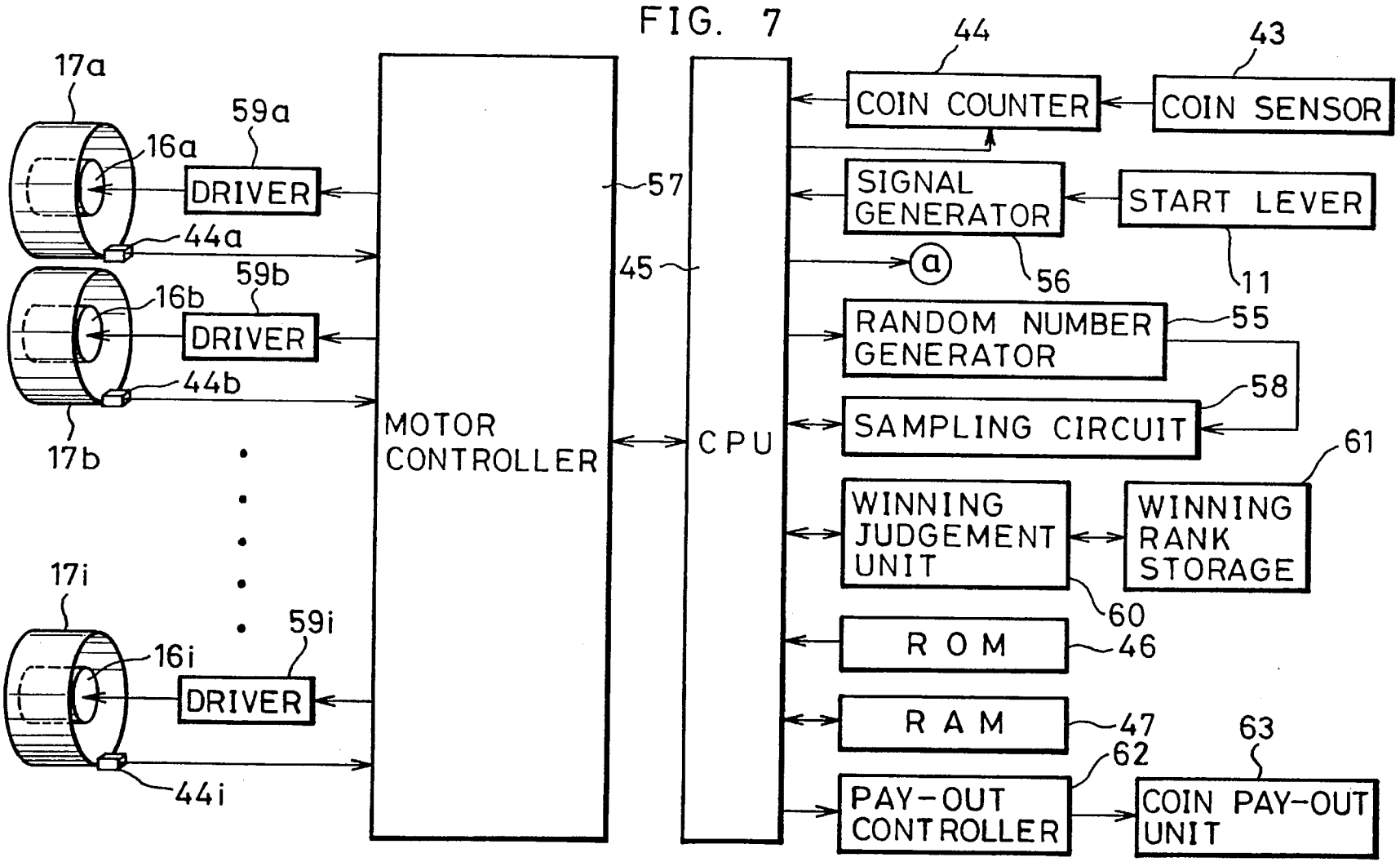
FIG. 7 is a block diagram of the electric circuit of the slot machine.
Figure 8:
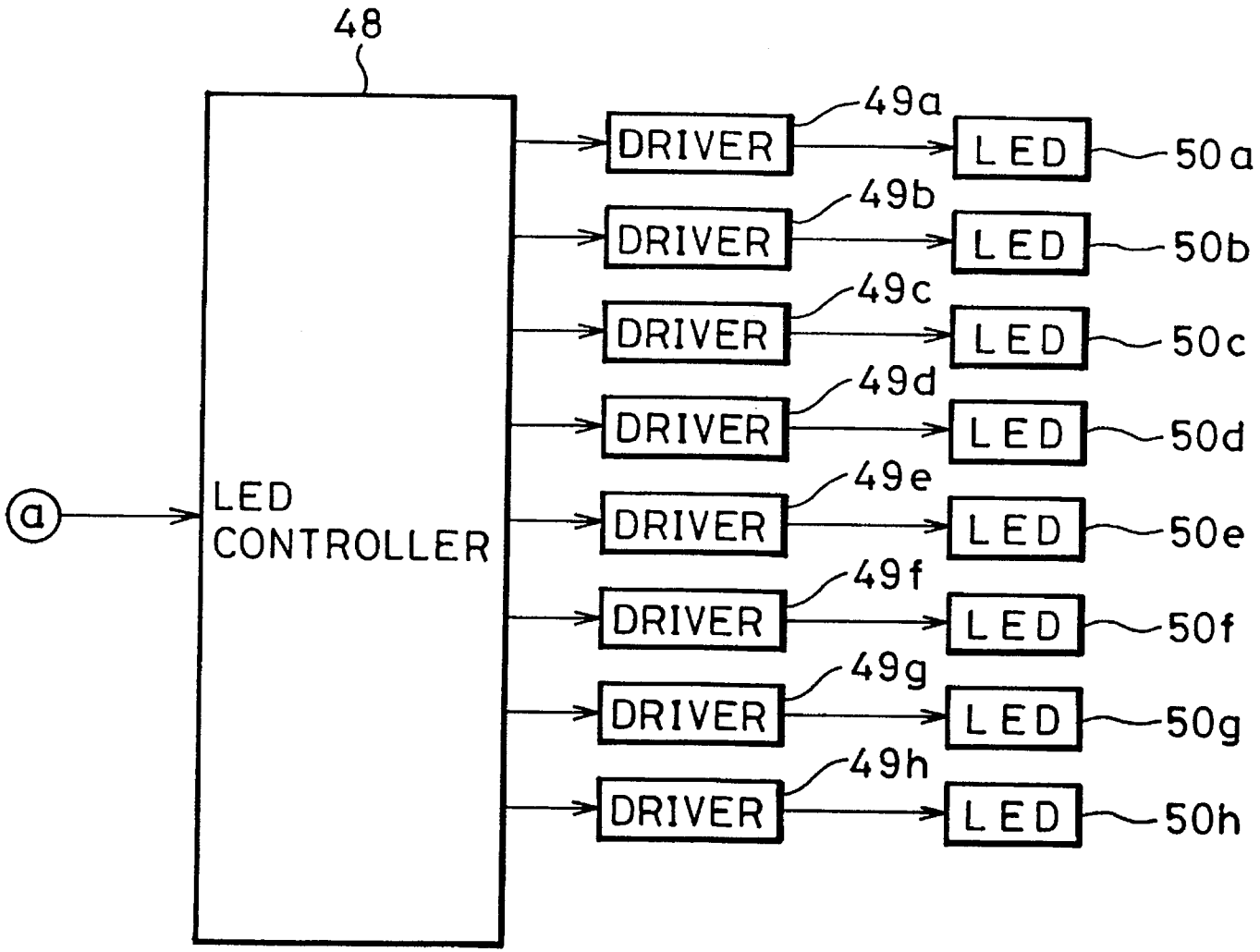
FIG. 8 is a block diagram of a winning display unit.

Referring to FIG. 7, the coin sensor 43 detects each genuine coin discriminated by the coin discriminator and sends a detection signal to a coin counter 44 which counts the detection signal and sends a count value to a CPU 45. When a game starts, the coin counter 44 is reset by CPU 45. A ROM 46 stores game programs.

CPU 45 writes the coin count value in RAM 47, and identifies valid lines, that is, the lines that have been paid for and so will be played, corresponding to the coin count value. The valid line data are sent from CPU 45 to an illumination controller 48. The illumination control 48 controls drivers 49*a* to 49*h* to continuously illuminate the LEDs from among LEDs 50*a* to 50*h* corresponding to the valid lines among lines 6*a* to 6*h*. For example, for the coin count value of "1", LEDs 50*a* of the valid line 6*a* are continuously illuminated. For the coin count value of "2", LEDs 50*a* to 50*c* corresponding to the valid lines 6*a*, 6*b* and 6*c* are continuously illuminated. For the coin count value of "3", LEDs 50*a* to 50*e* corresponding to the valid lines 6*a*, 6*b*, 6*c*, 6*d* and 6*e* are continuously illuminated. For the coin count of "4", LEDs 50*a* to 50*h* corresponding to the valid lines 6*a*, 6*b*, 6*c*, 6*d*, 6*e*, 6*f*, 6*g* and 6*h* are continuously illuminated.

After a coin or coins are inserted, CPU 45 activates a random number generator 55 and awaits a start signal from a signal generator 56 which generates the start signal when the start lever 11 is operated. Upon reception of the start signal, CPU 45 sends it to a motor controller 57 and a sampling circuit 58. The motor controller 57 controls drivers 59*a* to 59*i* to drive the pulse motors 16*a* to 16*i* and rotate the first to ninth reels 17*a* to 17*i* at the same time. During the rotation of each reel 17, a home position detection signal is generated each time the recess 32 passes through the photo sensor 41, and this detection signal is sent to a pulse motor controller 57. Nine reel counters for counting pulses supplied to respective pulse motors are provided in the motor controller 57. Each reel counter is reset by the home position detection signal of the corresponding reel. The rotated position of each reel is determined from the count value of each reel counter. These rotated position data are sent to CPU 45.

The sampling circuit 58 responds to the start signal and samples one random number in a predetermined range from a train of random numbers. The sampled random number is sent via CPU to a winning judgment unit 60. A winning rank storage 61 stores therein a symbol combination and the number of pay-out coins for each of the random numbers to be sampled. Referring to the winning rank storage 61, the winning judgment unit 60 determines the reel stop positions and the number of pay-out coins of the played game, in accordance with the sampled random number, and sends the reel stop position data and pay-out coin number data to CPU 45. CPU 45 causes the pay-out coin number data to be stored in RAM 47 and sends the reel stop position data to the motor controller 57.

After the lapse of a predetermined time after the start lever 11 is operated, CPU 45 instructs the motor controller 57 to perform a reel stop control. The motor controller 57 performs the stop control for the pulse motors 16*a* to 16*i* in accordance with the reel stop position data, to thus stop the nine reels 17*a* to 17*i* in the order of the numbers shown in FIG. 9. With this stop control, the symbol combination determined by the winning judgment unit 60 appears on the winning line. The symbol combination is checked by CPU 45 after all the reels 17 stop. Specifically, since CPU 45 stores data representing the relationship between a reel count value and a symbol, each symbol can be checked from the reel count value at the time the reel stops.

This check result is sent from CPU 45 to the illumination controller 48 which controls the driver to flash the LEDs of the winning line on which the winning symbol combination has been established. CPU 45 sends the pay-out coin number stored in RAM 47 to a pay-out controller 62 which drives a coin pay-out unit 63 to pay out the dividend coins.

The operation of the embodiment of FIG. 9 will be described next. If for example four coins are inserted into the coin inlet 10, all the winning lines 6*a* to 6*h* are made valid and LEDs 50*a* to 50*h* are illuminated. Thereafter, as the start lever 11 is operated, the nine reels 17*a* to 17*i* rotate at the same time. During the rotation of the reels, referring to the winning rank storage 61, the winning judgment unit 60 generates the reel stop position data and pay-out coin number data in accordance with the sampled random number, and sends the data to CPU 45 and motor controller 57.

Figure 9:
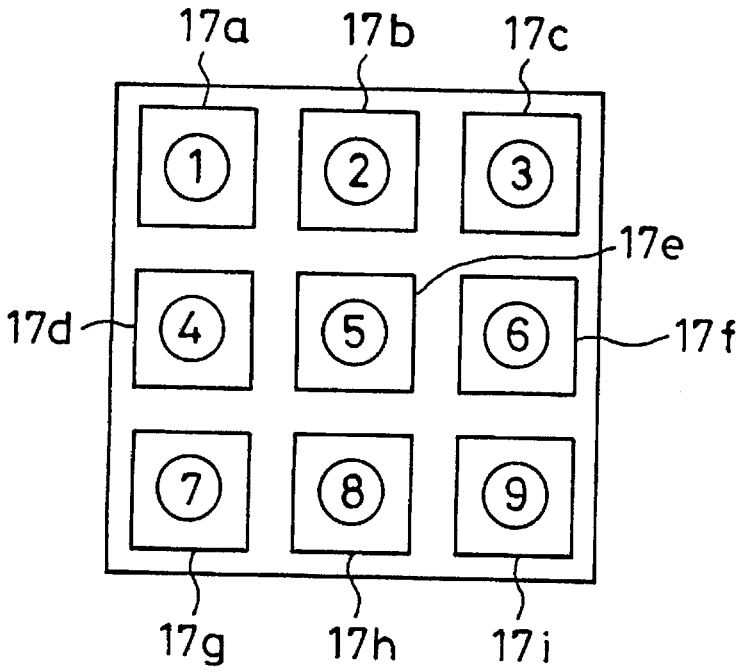
FIG. 9 is a diagram explaining one example of the order of stopping of the reels.

After the lapse of the predetermined time, as the stop signal is supplied from CPU 45, the motor controller 57 stops the pulse motors 16*a* to 16*i* in the order of the numbers shown in FIG. 9. When all the reels 17 stop and if any winning symbol combination appears on any valid winning line, coins corresponding in number to the rank of the winning combination are paid out. For example, if a symbol combination of "7—7—7" appears on the winning line 6*c*, the illumination controller 48 flashes LEDs 50*c* which have previously been continuously illuminated. This winning symbol combination has the highest rank, and so the largest number of coins are paid out into the saucer 18. A special bonus favor described previously is also given to allow the player to have a predetermined number of bonus games.

In this embodiment, even if the symbol "7" does not appear in any observation window in the second row, there is the possibility of forming a symbol combination of "7—7—7" on the bottom row, which is still in motion, thereby maintaining the player's interest in the game. Furthermore, since the symbol combinations on the winning lines 6*c*, 6*d* and 6*h* are determined when the last reel 17*i* stops, the interest in the game continues until the last reel stops. As described above, the slot machine of this invention has an increased number of winning lines, thereby increasing the player's expectation of a win.

Figure 10:
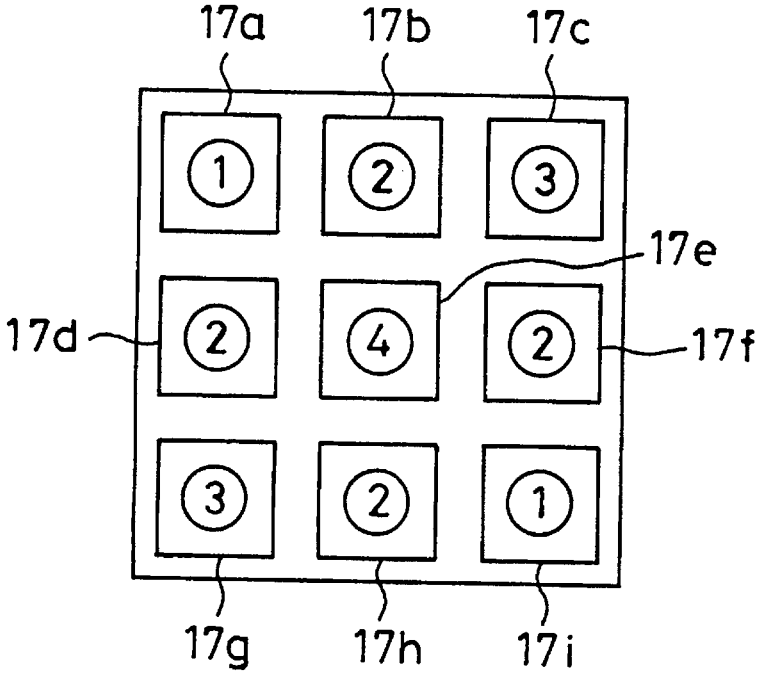
FIG. 10 is a diagram explaining another example of the order of stopping of the reels.

FIG. 10 shows another example of the order of stopping of the reels. In this example, the center reel 17*e* stops last so that the four symbol combinations are completed only at the end of a game. Accordingly, the hope of winning is maintained until all the reels stop, making the player enjoy the game longer. Other different orders of stopping of the reels may be used.

In the above embodiment, an auto-stop type slot machine has been described. The present invention is also applicable to a manual stop type slot machine in which reels are stopped upon actuation of stop buttons. If the same symbol appears on the nine reels or on the four corner reels, a win may be given. If the same symbols appear on the winning lines 6*a* and 6*g* in the shape of a cross, a win may also be given. Furthermore, the invention is applicable to a slot machine of the type using a pre-paid card or a credit card.

Although the present invention has been described with reference to the preferred embodiments shown in the drawings, the invention is not limited by these embodiments but, on the contrary, various modifications, changes, combinations and the like of the present invention can be effected without departing from the spirit and scope of the invention as defined by the appended claims.

What is claimed is:

1. A slot machine comprising:

a plurality of observation windows arranged in an M×N matrix, each of M and N being 3;

a plurality of rotatable reels mounted each behind one of said plurality of observation windows, said plurality of rotatable reels each having a train of symbols affixed on an outer circumference of each of said plurality of rotatable reels;

a plurality of motors each arranged for driving respective one of said plurality of rotatable reels;

said plurality of rotatable reels each having a train of symbols being adapted to form a plurality of possible winning lines along row lines, column lines and diagonal lines of said M×N matrix; and means for automatically and sequentially stopping said plurality of reels with the reel at the center of said matrix arrangement always stopping last.

2. A slot machine according to claim 1, wherein said plurality of winning lines are made valid in accordance with the number of inserted coins.

3. A slot machine according to claim 1, wherein one symbol of each said train of symbols is positioned at the center of each of said observation windows when said reels stop, and wherein incomplete and partially shielded symbols appear in the upper and lower areas of each said observation window when said reels stop.

4. A slot machine comprising:

a plurality of observation windows arranged in an M×N matrix, each of M and N being an integer equal to at least two;

a plurality of rotatable reels mounted each behind one of said plurality of observation windows, said plurality of rotatable reels each having a train of symbols affixed on an outer circumference of each of said plurality of rotatable reels;

a plurality of motors each arranged for driving a respective one of said plurality of rotatable reels;

said plurality of rotatable reels each having a train of symbols being adapted to form a plurality of possible winning lines along row lines, column lines and diagonal lines of said M×N matrix, wherein said plurality of possible winning lines are enabled by the insertion of a plurality of coins, one coin being sufficient to enable one possible winning line; and LEDs disposed along each of said plurality of possible winning lines, said LEDs disposed along said enabled possible winning lines being continuously illuminated, and if any winning symbol combination appears on any of said enabled possible winning lines, said LEDs disposed along said any winning symbol combination automatically changing to flashing from continuous illumination.

5. A slot machine according to claim 4, wherein one symbol of each said train of symbols is positioned at the center of each of said observation windows when said reels stop, and wherein incomplete and partially shielded symbols appear in the upper and lower areas of each said observation window when said reels stop.

* * * * *

UNITED STATES PATENT AND TRADEMARK OFFICE

CERTIFICATE OF CORRECTION

PATENT NO. : 5,584,764
DATED : December 17, 1996
INVENTOR(S) : Haruo Inoue

It is certified that error appears in the above-identified patent and that said Letters Patent is hereby corrected as shown below:

Title page,
Item [56], add the following:

-- References Cited

U.S. PATENT DOCUMENTS

| | | |
|---|---|---|
| 4,718,672 | 1/1988 | Okada |

FOREIGN PATENT DOCUMENTS

| | | |
|---|---|---|
| 62-84484 | 5/1987 | Japan |
| 4-108468 | 4/1992 | Japan |
| 4-109977 | 4/1992 | Japan -- |

Signed and Sealed this

Twenty-third Day of March, 2004

JON W. DUDAS
*Acting Director of the United States Patent and Trademark Office*